United States Patent [19]

Hensel, Jr.

[11] 4,121,717

[45] Oct. 24, 1978

[54] SLIDE BRACKET SUPPORTING ASSEMBLY

[76] Inventor: Alden C. Hensel, Jr., 1127 Donwayne Dr., Lapeer, Mich. 48446

[21] Appl. No.: 751,175

[22] Filed: Dec. 16, 1976

[51] Int. Cl.[2] ..... A47F 7/16

[52] U.S. Cl. ..... 211/46; 16/94 R; 211/94

[58] Field of Search ..... 211/45, 46, 94, 162, 211/123, 124; 16/93 D, 95 D, 94 D, 96 D; 40/124

[56] References Cited

U.S. PATENT DOCUMENTS

| | | | |
|---|---|---|---|
| 1,199,773 | 10/1916 | Ericson et al. | 211/46 |
| 2,269,310 | 1/1942 | Hollander | 211/94 |
| 2,946,454 | 7/1960 | Asher | 211/45 |
| 3,051,318 | 8/1962 | Murphy | 211/94 |
| 3,195,733 | 7/1965 | Best | 211/45 |
| 3,248,749 | 5/1966 | Williams | 16/93 D |

FOREIGN PATENT DOCUMENTS

| | | | |
|---|---|---|---|
| 251,798 | 1/1967 | Austria | 16/93 D |
| 170,348 | 4/1960 | Sweden | 211/62 |
| 791,345 | 2/1958 | United Kingdom | 211/46 |

*Primary Examiner*—Roy D. Frazier
*Assistant Examiner*—Robert W. Gibson, Jr.
*Attorney, Agent, or Firm*—Harness, Dickey & Pierce

[57] ABSTRACT

A slide bracket supporting assembly particularly applicable for use in display racks and storage of articles including a track defining a slot in which a plurality of slide brackets are removably engaged for stacked sliding movement therealong. Each slide bracket incorporates a mounting member for securing an article, such as a fabric or carpet sample, thereto. The slide bracket includes a T-shaped dog connected to an elongated body formed with a rearwardly extending flange adapted to be slidably disposed within the slot, preventing relative rotation of the slide bracket and the slot. The T-shaped dog is adapted to be removably engaged in the track, whereby the slide bracket and the article mounted thereon can readily be removed by outward tilting of the slide bracket relative to the track and a rotation thereof through an angularity of about 90°, enabling extraction of the dog from engagement with the track.

7 Claims, 11 Drawing Figures

FIG. 1.
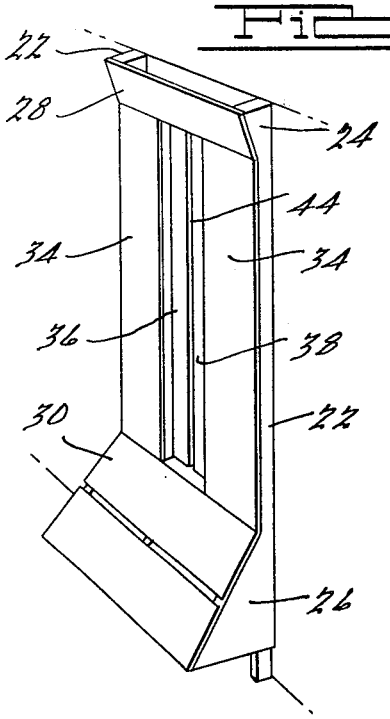
FIG. 2.
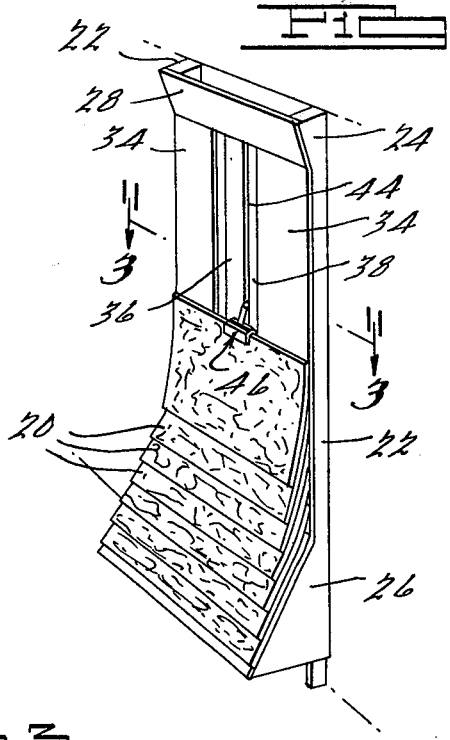
FIG. 3.
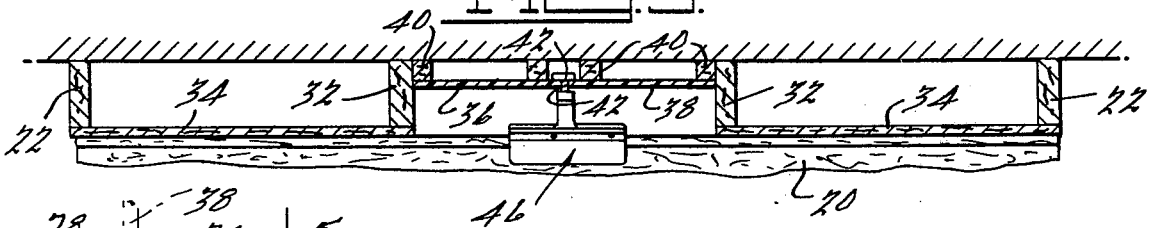
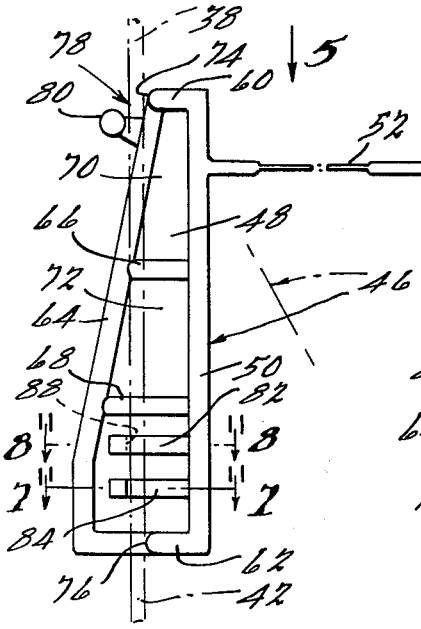
FIG. 4.
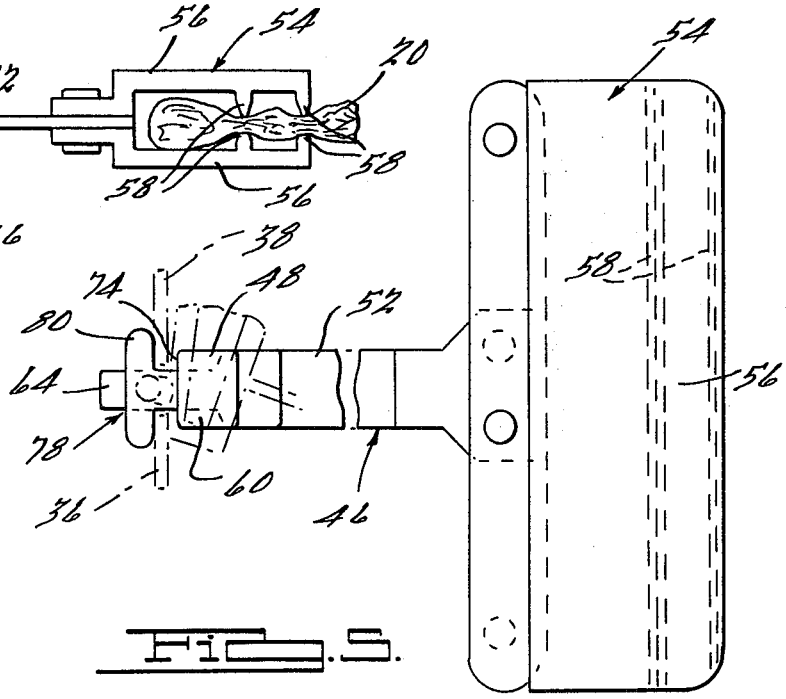
FIG. 5.

SLIDE BRACKET SUPPORTING ASSEMBLY

BACKGROUND OF THE INVENTION

The slide bracket supporting assembly of the present invention is particularly applicable but not necessarily restricted to use in display racks in which a plurality of samples such as carpet samples, for example, are displayed in stacked overlying relationship. In display rack constructions of the types heretofore known, a continuing problem has been associated in effecting a quick and simple removal of one or more of the samples from the rack for close inspection and for a return of the sample or samples in appropriate stacked relationship on the rack after inspection has been completed. Similar problems have been encountered in the storage of articles, such as clothing, in confined spaces or closets, such as in trailers and mobile homes having limited storage facilities.

The slide bracket supporting assembly of the present invention overcomes many of the problems and disadvantages associated with prior art display racks and storage systems by providing a simple and economical slide bracket and track assembly for slidably supporting a plurality of articles in stacked relationship on a track and wherein individual ones of such slide brackets and the attached article can readily be extracted from the track and subsequently replaced without disturbing the remaining articles, providing thereby improved efficiency of operation and utilization of space.

SUMMARY OF THE INVENTION

The benefits and advantages of the present invention are achieved by a slide bracket supporting assembly including a supporting framework incorporating a generally upright track thereon, which is formed with an elongated slot in which one or a plurality of slide brackets are removably mounted in stacked relationship for sliding movement therealong. Each slide bracket comprises an elongated body including a rearwardly projecting flange which is adapted to be slidably disposed between the opposed edges of the slot, thereby preventing inadvertent rotary movement of the slide bracket relative to the axis of the track. A mounting device, such as a clamp, for example, is mounted on the upper portion of the body and projects forwardly thereof for removably securing an article such as a garment or a carpet sample, for example, thereto. A T-shaped dog including a transverse engaging bar is connected to the upper portion of the body, and projects rearwardly thereof and is adapted to be disposed in engaged relationship against the rearward surfaces of the track adjacent to the edges of the slot therealong. The engaging bar is of a minor dimension, less than the width of the slot, and is of a length greater than the width of the slot such that its transverse projecting end portions overlie and engage the back face of the slot defining members, effecting an interlock of the slide bracket and the track. The body member further includes, in accordance with a preferred embodiment, engaging tangs adjacent to the lower portion thereof for removably engaging the track, preventing inadvertent tilting movement of the body about the axis of the engaging bar outwardly of the track. The body member further incorporates coacting stops restricting inward movement of the body through the slots beyond a preselected distance. The engaging means are releaseable, enabling the body member to be tilted outwardly to release the flange from engagement with the slot, thereby enabling the entire body to be rotated through an angularity of substantially 90°, whereby the engaging bar is disposed in alignment with the slot axis, enabling extraction of the slide bracket from the track and the removal of the article attached thereto for inspection. The track is adapted to be arranged in a generally upright orientation, whereby the plurality of slide brackets are disposed with the individual body sections thereof in stacked abutting relationship and move downwardly in response to the action of gravity upon removal of one or more of the slide brackets disposed therebelow.

Additional benefits and advantages of the present invention will become apparent upon a reading of the description of the preferred embodiments, taken in conjunction with the accompanying drawings.

BRIEF DESCRIPTION OF THE DRAWINGS

FIG. 1 is a perspective view of a display rack framework incorporating a track in accordance with one of the embodiments of the present invention;

FIG. 2 is a perspective view of the display rack framework shown in FIG. 1 incorporating a plurality of rectangular samples slidably supported in vertically stacked relationship along the front panel thereof by means of a plurality of slide brackets;

FIG. 3 is an enlarged transverse sectional view of the display rack shown in FIG. 2 and taken substantially along the line 3—3 thereof;

FIG. 4 is an enlarged side elevational view of a slide bracket disposed in an engaged position in a track fragmentarily shown in phantom;

FIG. 5 is a plan view of the slide bracket shown in FIG. 4 as viewed in the direction of the arrow indicated at 5 therein;

DESCRIPTION OF THE PREFERRED EMBODIMENTS

Figure 7:
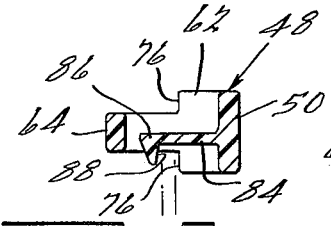
FIG. 7 is a transverse sectional view of an engaging tang of the slide bracket shown in FIG. 4 and taken substantially along the line 7—7 thereof.
Figure 8:
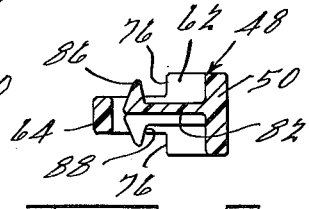
FIG. 8 is a transverse sectional view of an engaging tang of the slide bracket shown in FIG. 4 and taken substantially along the line 8—8 thereof.

Referring now in detail to the drawings and as may be best seen in FIGS. 1–3 thereof, a slide bracket supporting assembly is shown in a display rack arrangement for displaying a plurality of samples or articles such as, for example, a plurality of rectangular carpet samples 20 in stacked overlying relationship as best seen in FIG. 2. It will be understood by those skilled in the art that the slide bracket supporting assembly of the present invention is equally applicable for use in a variety of alternative arrangements for supporting one or a plurality of articles in stacked relationship for display, storage or other purposes, wherein extraction or removal of one of such articles can readily be effected in a manner hereinafter to be described.

As shown in FIGS. 1–3, the display rack comprises a pair of spaced apart side panels 22 having an angularly formed upper portion 24 and lower portion 26 between which an upper face panel 28 and a lower face panel 30 extends and is securely fastened thereto. The framework further includes a pair of upright intermediate frame members 32 disposed substantially parallel to the side panels 22, to which intermediate face panels 34 are secured. A pair of supporting panels 36, 38 are affixed to vertical stringers 40 extending between the intermediate supports 32 and are securely fastened thereto. The supporting panels 36, 38 are provided with longitudinally extending upright edges 42 which are disposed in opposed spaced substantially parallel relationship defining an elongated vertically oriented slot 44 in which a plurality of slide brackets 46 are slidably engaged for sliding movement therealong. The supporting panels 36, 38 are preferably comprised of a plastic material of adequate mechanical strength such as nylon, acrylic resins, high impact polystyrene, olefin resins, or the like, which inherently possess lubricity characteristics, thereby facilitating relative sliding movement of the slide brackets. The slide brackets also are preferably comprised of an integral molded plastic material of similar type.

Figure 6:
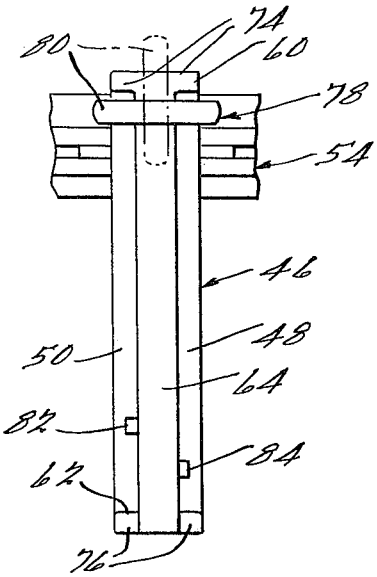
FIG. 6 is a rear elevational view of the slide bracket shown in FIGS. 4 and 5.

As best seen in FIGS. 4–6, each of the slide brackets 46 is comprised of an elongated body 48 including a frontal web 50 to the upper portion of which is affixed a thin flexible web 52 having an engaging clamp 54 affixed to the outward end thereof. The specific configuration and structure of the engaging clamp 54 will vary depending upon the particular type of article to be supported from the slide bracket. In the specific embodiment illustrated, the engaging clamp 54 comprises a pair of transversely elongated and opposed C-shaped members 56 formed with opposed transversely extending engaging rails 58 which are adapted to become resiliently embedded in engaging relationship with the edge portion of the rectangular carpet sample 20 for supporting each sample along its upper edge in a manner as best illustrated in FIGS. 2 and 3. The C-shaped members 56 are comprised of a resilient plastic material which in response to outward deflection of the members to receive a sample therebetween, continually urges the members and the engaging rails thereon into clamped engaging relationship with the sample interposed therebetween.

The frontal web 50 of the body is integrally formed with a rearwardly projecting upper web 60 and a lower web 62 to which a rearwardly projecting flange 64 is integrally affixed and extends therebetween. The flange 64 is reinforced at positions intermediate the ends of the body by means of transverse braces 66, 68 and reinforcing webs 70, 72, integrally formed and extending between the area therebetween.

As will be noted in FIGS. 4–6, the flange 64 is of a transverse width less than that of the width of the slot, enabling tilting movement of the body member inwardly, wherein the side portions of the flange slidably engage the edges of the slot, preventing inadvertent rotary movement of the body member in the plane of the supporting panels relative to the axis of the slot. The intersection of the flange 64 with the upper web 60 and lower web 62 of greater width form transversely extending shoulders 74, 76, respectively, which serve as stop means restricting inward movement of the body through the slot, preventing inward movement of the body through the slot beyond a preselected point in response to the abutting coaction of the shoulders against the outer face of the support panels adjacent to the edges defining the slot therebetween.

A T-shaped dog 78 including a transverse engaging bar 80 is affixed to and projects rearwardly of the upper portion of the flange 64. The thickness or diameter of the engaging bar 80 in a minor dimension is less than the width of the slot, while the length or transverse width of the engaging bar is greater than the width of the slot, such that the end portions of the engaging bar, when the slide bracket is disposed in engaged relationship within the slot, is positioned in abutting sliding relationship against the back face of the supporting panels adjacent to the edges defining the slot 44.

In accordance with the foregoing arrangement, a mounting of a slide bracket in sliding engagement with the track is effected by positioning the slide bracket with the length of the engaging bar in alignment with the slot, enabling the insertion of the engaging bar past the rearward edges of the supporting panels whereupon rotation of the body through an angularity of approximately 90° causes the projecting end portions of the engaging bar to become interlocked behind the edge portions of the supporting panels in an engaged relationship as shown in FIGS. 4 and 5. The engaging bar oriented in an aligned position with the slot is illustrated in phantom in FIGS. 5 and 6. After engagement of the bar with the edge portions of the slot, the body member is pivoted inwardly from the position as fragmentarily shown in phantom in FIG. 4 inwardly to a position in which the flange 64 passes through the slot, locking the supporting bracket against further inadvertent rotary movement. Inward movement of the body member beyond a preselected point is prevented by the engagement of the shoulders 74 and 76 against the faces of the supporting panels.

When in the installed position, the slide bracket moves downwardly in response to the action of gravity until the lower portion of the body is disposed in abutting supported relationship against the base of the slot or the upper portion of a slide bracket disposed therebelow. Accordingly, by controlling the length or height of the body member of each slide bracket, a preselected uniform spacing of the engaging clamp 54 along the track is effected, whereby the samples, such as the carpet samples 20, are neatly stacked in staggered overlying relationship. In the display of carpet samples, for example, it is desirable to provide an exposed length of individual samples of about 3 inches, whereby the body length of the slide brackets are fabricated in corresponding three inch lengths to provide the necessary spacing.

In accordance with a preferred embodiment of the present invention, each slide bracket is provided with engaging means adjacent to the lower portion of the body, restricting inadvertent tilting movement of the rearwardly projecting flange 64 outwardly of the slot. In the specific embodiment as illustrated in FIGS. 4–6, a resilient engaging tang 82 and a resilient engaging tang 84 are disposed in vertically spaced relationship and are integrally affixed and project rearwardly of the frontal web 50. Each of the engaging tangs 82, 84 is formed with a hook-shaped end portion 86 which is adapted to overlie and engage the edge portion of the supporting panels defining the slot. Each hook-shaped portion 86 is formed with an angularly inclined engaging face 88 disposed at a position inwardly of the face of the lower shoulder 76 a distance sufficient to accommodate the thickness of the supporting panel, which is fragmentarily illustrated in phantom in FIGS. 4 and 7. The angularity of the engaging face 88 imparts an inward camming movement to the resilient engaging tangs 82, 84 in response to an outward pulling force applied to the lower portion of the body member during removal of the slide bracket, whereby the hook-shaped portions are cammed inwardly, enabling extraction thereof through the slot, permitting the body member to be tilted until stopped by the shoulder 74 to a disengaging condition as illustrated in phantom in FIG. 4. Thereupon, the body member can be rotated through an angularity of approximately 90°, wherein the engaging bar is vertically aligned with the slot as shown in phantom in FIG. 6, enabling extraction of the slide bracket from the track.

Figure 9:
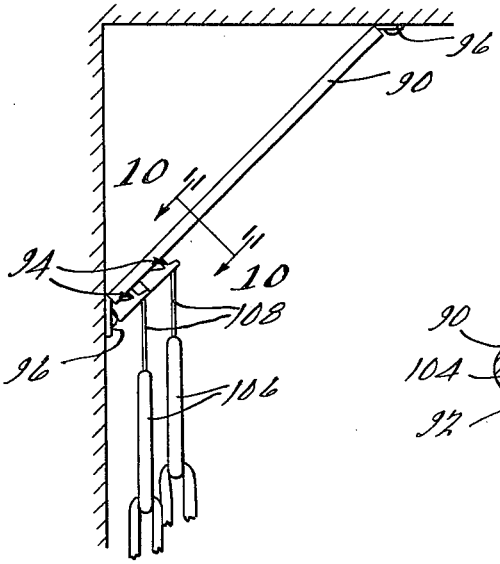
FIG. 9 is a fragmentary side elevational view of a slide bracket supporting assembly utilized in a storage system in accordance with an alternative embodiment of the present invention.
Figure 10:
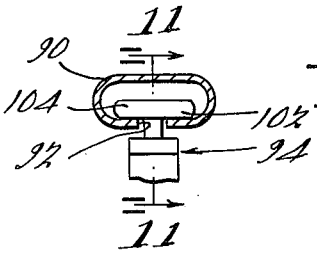
FIG. 10 is a transverse enlarged sectional view through the track of the assembly shown in FIG. 9 and taken substantially along the line 10—10 thereof.
Figure 11:
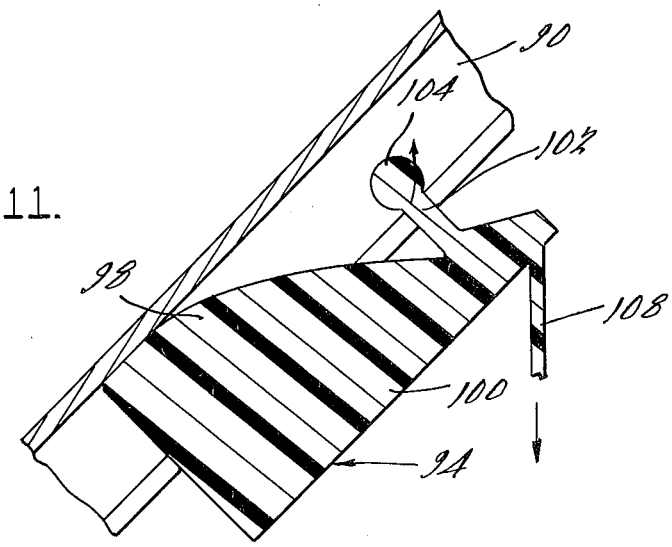
FIG. 11 is a magnified longitudinal sectional view of the slide bracket and track assembly shown in FIG. 10 and taken substantially along the line 11—11 thereof.

In accordance with an alternative embodiment of the present invention, the slide bracket supporting assembly is utilized for a storage of articles such as clothing utilizing a generally upright or inclined track 90, as best seen in FIGS. 9–11. As shown, the track 90 is of a generally C-shaped configuration defining an elongated slot 92 for slidably receiving a plurality of slide brackets 94. Each end of the track 90 is formed with a tab 96 enabling attachment of the track to a surrounding structure, such as the walls and ceiling of a closet, for example.

The slide brackets 94, as shown in FIGS. 9–11, are similar to the slide brackets 46 previously described but do not employ resilient engaging tangs for retaining an arcuate flange portion 98 thereof in engagement in the slot 92. As shown, the slide bracket is comprised of a body 100, including a T-shaped dog 102 having a transverse engaging bar 104 securely affixed thereto, which is adapted to overlie the side edges of the track adjacent to the slot, effecting engagement thereof. The engaging bar 104, as in the previous instance, is of a thickness or diameter in its minor dimension less than the width of the slot and is of a length or width in its major dimension such that the end portions thereof overlie the adjacent edge portions of the track in a manner as best seen in FIG. 10. A mounting device 106, such as a clothes hanger, for example, is connected by means of a flexible web 108 to the upper portion of the body member at a location outwardly of a vertical axis passing through the point of contact of the periphery of the engaging bar and the inner surfaces of the track. This offset relationship between the downward pull of the weight of the article on the mounting device applies a torque to the slide bracket in a clockwise direction, as viewed in FIG. 11, tending to urge the arcuate flange portion 98 of the slide bracket into engagement with the slot in the track, preventing inadvertent disengagement thereof. The engaging torque thus provided obviates the need for mechanical engaging means, such as engaging tangs 82, 84, preventing relative tilting movement of the bracket and the track.

While it will be apparent that the invention herein disclosed is well calculated to fulfill the objectives and advantages set forth above, it will be appreciated that the invention is susceptible to modification, variation and change without departing from the spirit thereof.

What is claimed is:

1. In a slide bracket supporting assembly the combination comprising a framework including generally upright track means thereon comprised of a pair of opposed members having a front face and a back face and disposed with the opposed edges thereof in spaced substantially parallel relationship defining therebetween an elongated slot, at least one slide bracket removably engaged in said track means for sliding movement therealong, said slide bracket comprising an elongated body including a flange projecting rearwardly thereof and adapted to be removably disposed in said slot preventing inadvertent rotary movement of said body relative to the axis of said track means, mounting means on said body projecting forwardly of said track means for securing an article thereto, a T-shaped dog including a transverse engaging bar connected to the upper portion of and projecting rearwardly of said body, said bar having a thickness in its minor dimension less than the width of said slot and a transverse length greater than the width of said slot such that its projecting end portions overlie and engage said back face of said opposed members adjacent to the edges thereof, stop means on said body restricting movement of said body inwardly of said slot beyond a preselected depth, said slide bracket supported from said engaging bar on said track means for outward tilting movement of said body enabling withdrawal of said flange from said slot and rotation of said body to align said engaging bar with said slot enabling disengagement and extraction of said slide bracket from said track means, and engaging means on the lower portion of said body for removably engaging said track means preventing inadvertent tilting movement of said body about the transverse axis of said engaging bar outwardly of said slot.

2. The slide bracket supporting assembly as defined in claim 1, in which said slide bracket body is comprised of an integrally molded plastic material.

3. The slide bracket supporting assembly as defined in claim 1, in which said track means is oriented in a substantially vertical position.

4. In a slide bracket supporting assembly the combination comprising a framework including generally upright track means thereon comprised of a pair of opposed members having a front face and a back face and disposed with the opposed edges thereof in spaced substantially parallel relationship defining therebetween an elongated slot, at least one slide bracket removably engaged in said track means for sliding movement therealong, said slide bracket comprising an elongated body including a flange projecting rearwardly thereof and adapted to be removably disposed in said slot preventing inadvertent rotary movement of said body relative to the axis of said track means, mounting means attached to said body by a flexible member and projecting forwardly of said track means for securing an article thereto, a T-shaped dog including a transverse engaging bar connected to the upper portion of and projecting rearwardly of said body, said bar having a thickness in its minor dimension less than the width of said slot and a transverse length greater than the width of said slot such that its projecting end portions overlie and engage said back face of said opposed members adjacent to the edges thereof, stop means on said body restricting movement of said body inwardly of said slot beyond a preselected depth, said slide bracket supported from said engaging bar on said track means for outward tilting movement of said body enabling withdrawal of said flange from said slot and rotation of said body to align said engaging bar with said slot enabling disengagement and extraction of said slide bracket from said track means.

5. The slide bracket supporting assembly as defined in claim 4, in which said track means is oriented in an angularly inclined position with said slot facing downwardly.

6. The slide bracket supporting assembly as defined in claim 4, in which said mounting means are attached to said body at a point positioned horizontally outwardly of the position of engagement between said engaging bar and said track means applying a couple to said slide bracket in a direction urging said flange inwardly of said track means through said slot.

7. In a slide bracket supporting assembly the combination comprising a framework including generally upright track means thereon comprised of a pair of opposed members having a front face and a back face and disposed with the opposed edges thereof in spaced substantially parallel relationship defining therebetween an elongated slot, at least one slide bracket removably engaged in said track means for sliding movement therealong, said slide bracket comprising an elongated body including a flange projecting rearwardly thereof and adapted to be removably disposed in said slot preventing inadvertent rotary movement of said body relative to the axis of said track means, mounting means on said body projecting forwardly of said track means comprising a resiliently biased clamp for resiliently clamping an article therebetween, said clamp connected to said body of said slide bracket by a resilient web, a T-shaped dog including a transverse engaging bar connected to the upper portion of and projecting rearwardly of said body, said bar having a thickness in its minor dimension less than the width of said slot and a transverse length greater than the width of said slot such that its projecting end portions overlie and engage said back face of said opposed members adjacent to the edges thereof, stop means on said body restricting movement of said body inwardly of said slot beyond a preselected depth, said slide bracket supported from said engaging bar on said track means for outward tilting movement of said body enabling withdrawal of said flange from said slot and rotation of said body to align said engaging bar with said slot enabling disengagement and extraction of said slide bracket from said track means.

* * * * *